US009145005B2

(12) United States Patent
Oki et al.

(10) Patent No.: US 9,145,005 B2
(45) Date of Patent: Sep. 29, 2015

(54) RECORDING DEVICE

(71) Applicant: SEIKO EPSON CORPORATION, Tokyo (JP)

(72) Inventors: Narihiro Oki, Matsumoto (JP); Tetsuya Tamura, Matsumoto (JP); Tatsuya Shirane, Shiojii (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/228,662

(22) Filed: Mar. 28, 2014

(65) Prior Publication Data

US 2014/0292986 A1 Oct. 2, 2014

(30) Foreign Application Priority Data

Mar. 29, 2013 (JP) ..... 2013-071600
Sep. 13, 2013 (JP) ..... 2013-190195

(51) Int. Cl.

| | |
|---|---|
| ***B41J 2/01*** | (2006.01) |
| ***B41J 3/60*** | (2006.01) |
| ***B41J 11/00*** | (2006.01) |
| ***B41J 29/02*** | (2006.01) |

(52) U.S. Cl.

CPC ..... *B41J 3/60* (2013.01); *B41J 11/0095* (2013.01); *B41J 29/023* (2013.01)

(58) Field of Classification Search

CPC ..... B41J 11/0095
USPC ..... 347/104
See application file for complete search history.

(56) References Cited

U.S. PATENT DOCUMENTS

| | | | | |
|---|---|---|---|---|
| 2007/0023997 | A1 * | 2/2007 | Ertel et al. | 271/265.01 |
| 2008/0043580 | A1 * | 2/2008 | Kotaka et al. | 369/44.18 |
| 2011/0049791 | A1 | 3/2011 | Osakabe | |

FOREIGN PATENT DOCUMENTS

| | | |
|---|---|---|
| JP | 2011-046497 | 3/2011 |
| JP | 2012-240813 | 12/2012 |

* cited by examiner

*Primary Examiner* — Julian Huffman
*Assistant Examiner* — Sharon A Polk
(74) *Attorney, Agent, or Firm* — Workman Nydegger

(57) ABSTRACT

A printer includes a device main body having a recording head, and a double-sided printing unit that forms an inverting transport path for inverting a medium fed from the side on which the recording head is located and that is configured to be mountable in and removable from the device main body. A photosensor that detects paper within the double-sided printing unit when the double-sided printing unit is mounted in the device main body detects the paper within the double-sided printing unit via an opening provided in an upper area of the double-sided printing unit.

10 Claims, 18 Drawing Sheets

RECORDING DEVICE

BACKGROUND

1. Technical Field

The present invention relates to recording devices such as facsimile machines, printers, and the like.

2. Related Art

Some recording devices, such as facsimile machines, printers, and the like, include inverting transport paths that invert recording paper, which is an example of a medium; and by inverting recording paper that has been recorded onto, a second surface (a rear surface) of the recording paper can be recorded onto in addition to a first surface (a front surface). Meanwhile, in the recording device disclosed in JP-A-2012-240813, an inverting roller that forms an inverting path for inverting recording paper is provided in a curved inverting unit that is removable from the main body of the recording device, and the configuration is such that removing the curved inverting unit exposes a paper transport path within the device.

Incidentally, a detection unit that detects the passage of a leading end or a following end of the paper has thus far been provided in an appropriate location in the paper transport path for the purpose of controlling the transport of the recording paper. There are cases where it is necessary to detect the passage of the paper through the curved inverting unit in the recording device disclosed in the aforementioned JP-A-2012-240813.

Electrical signals are exchanged between a control unit in the main body of the recording device and the detection unit, and thus in the case where the detection unit is provided in the curved inverting unit, it is necessary to provide electrical contacts between the removable curved inverting unit and the main body of the device. However, the contacts will degrade as the curved inverting unit is repeatedly attached and removed, leading to a risk that the electrical signals will no longer be able to be exchanged correctly between the control unit in the main body of the recording device and the detection unit.

Meanwhile, in the case where the detection unit is provided above the curved inverting unit, it is preferable to also provide a cover over the detection unit in order to protect the detection unit; however, providing such a cover makes it necessary to also provide a region for receiving the cover in a region above where the curved inverting unit is mounted in the main body of the device. However, some recording devices are configured as so-called complex machines in which a scanner is provided in an upper part of the main body of the device that has a recording mechanism, and in such a case, the aforementioned region for receiving the cover will interfere with the region where the scanner is installed, leading to an increase in the size of the device.

SUMMARY

An advantage of some aspects of the invention is to provide a recording device in a configuration where a paper transport path is formed in a removable unit body and paper is detected in the paper transport path so as to increase reliability of the device and suppress an increase in device size.

A recording device according to an aspect of the invention includes a device main body having a recording head that records onto a medium; a unit member that forms a medium transport path for transporting the medium and is configured to be mountable in and removable from the device main body; and a first detection unit, provided in the device main body, that detects, via an opening provided in the unit member, the medium passing through the medium transport path when the unit member is mounted in the device main body.

According to this aspect, the opening is provided in the unit member that forms the medium transport path and is configured to be mountable in and removable from the main body of the recording device, the first detection unit that detects the passing medium is provided in the main body of the recording device, and the first detection unit detects the medium passing through the medium transport path via the opening; accordingly, it is not necessary to provide an electrical contact between the unit member and the device main body, and the reliability of the device can be increased.

Furthermore, the first detection unit is provided in the device main body, and thus it is not necessary to make space for providing the first detection unit in the unit member. Accordingly, an increase in the height dimension of the device main body can be avoided, particularly compared to a configuration in which the first detection unit is provided in an upper area of the unit member.

In the first aspect of the invention, it is preferable that the medium transport path include an inverting transport path that inverts the medium fed from the side on which the recording head is located, and that the opening be provided in an upper area of the unit member.

According to this aspect, the same effects as in the aspect can be achieved in a configuration in which the unit member forms the inverting transport path that inverts the medium fed from the side on which the recording head is located and the opening is provided in an upper area of the unit member.

In the aspect of the invention, it is preferable that the unit member include a medium support surface that supports at least part of the medium before the medium is fed, and that a feed path for the medium fed toward the recording head via the medium support surface be formed when the unit member is mounted in the device main body.

According to this aspect, the unit member includes the medium support surface that supports at least part of the medium before the medium is fed, and the feed path for the medium fed toward the recording head via the medium support surface is formed when the unit member is mounted in the device main body; accordingly, removing the unit member exposes the feed path of the medium as well, making operations for clearing paper jams easier.

In the aspect of the invention, it is preferable that the feed path be formed so as to merge with the inverting transport path, and that the first detection unit be provided downstream from the point where the feed path and the inverting transport path merge.

According to this aspect, the inverting transport path can be used as a feed path for the paper inserted from the medium support surface, and thus an increase in the size of the recording device can be prevented. Furthermore, the first detection unit can detect the passage of the medium from the feed path.

In the aspect of the invention, it is preferable that the first detection unit detect the medium at a location upstream in a medium feed direction from a roller pair that nips the medium and that is located furthest upstream in the feed path of the medium fed via the medium support surface.

According to this aspect, the first detection unit detects the medium at a location upstream in the medium feed direction from the roller pair that nips the medium and that is located furthest upstream in the feed path of the medium fed via the medium support surface, and thus even in the case where a thin, flimsy medium is fed, the medium can be detected with certainty. In other words, although there is a risk that a thin, flimsy medium cannot pass the position of the nip formed by the roller pair and cannot be fed as a result, such a risk is eliminated by this aspect. If, for example, the roller pair is driven when the passage of the medium has been detected, even a thin, flimsy medium can be fed to a recording position with certainty.

In the aspect of the invention, it is preferable that at least part of a portion that configures the first detection unit project toward a region of the device main body in which the unit member is mounted, and that a groove that receives the projecting portion of the first detection unit be formed in an upper area of the unit member so as to extend in the direction along which the unit member is mounted and removed.

According to this aspect, at least part of the portion that configures the first detection unit projects toward a mounting region for the unit member, and the groove that receives the projecting portion is formed in an upper area of the unit member; accordingly, the projecting portion and the groove engaging with each other act to guide the mounting of the unit member when the unit member is mounted. This enables the unit member to be mounted in the proper position.

In the aspect of the invention, it is preferable that an image reading unit be provided in an upper area of the device main body, and a signal line of the first detection unit be disposed in a pathway of a connection cable that electrically connects the image reading unit to the device main body.

According to this aspect, the signal line of the first detection unit is disposed in the pathway of the connection cable that electrically connects the image reading unit to the device main body, and thus it is not necessary to provide a dedicated pathway for disposing the signal line from the first detection unit, making it possible to avoid complicating the device configuration and to increase the ease of assembly of the device.

In the aspect of the invention, it is preferable that the first detection unit be a photosensor including a light-emitting portion that emits detection light toward the opening and a light-receiving portion that receives reflected light from the opening.

According to this aspect, the first detection unit is a photosensor including the light-emitting portion and the light-receiving portion, or in other words, is a non-contact detection unit; accordingly, there is no risk that the first detection unit will be damaged when the unit member is mounted or removed.

In the aspect of the invention, it is preferable that the recording device further include a second detection unit, provided in the device main body, that detects the medium passing through the feed path upstream in the feed path from the point where the inverting transport path and the feed path merge.

According to this aspect, in the case where a user has mistakenly inserted paper from a manual feed path when paper fed from a tray is transported downstream, a warning can be issued to the user, the rotation of an intermediate roller that configures the inverting transport path can be stopped, or both. As a result, paper jams caused by the two papers colliding can be prevented, the two papers can be prevented from being fed at the same time, and so on. Furthermore, it is not necessary to provide an electrical contact between the unit member and the device main body, and the reliability of the device can be increased.

In the aspect of the invention, it is preferable that the recording device further include a biasing portion that biases the medium passing the opening toward the outside of the opening.

According to this aspect, the biasing portion that biases the medium passing the opening toward the outside of the opening is provided; as a result, the position at which the medium passes relative to the opening does not easily vary, and thus the medium that passes the position of the opening can be properly detected by the first detection unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described hereinafter with reference to the drawings. However, it should be noted that the invention is not intended to be limited to the following embodiments, and many variations are possible without departing from the scope of the invention according to the appended aspects of the invention; such variations are also to be considered as falling within the scope of the invention, and the following describes merely several embodiments of the invention.

Figure 1:
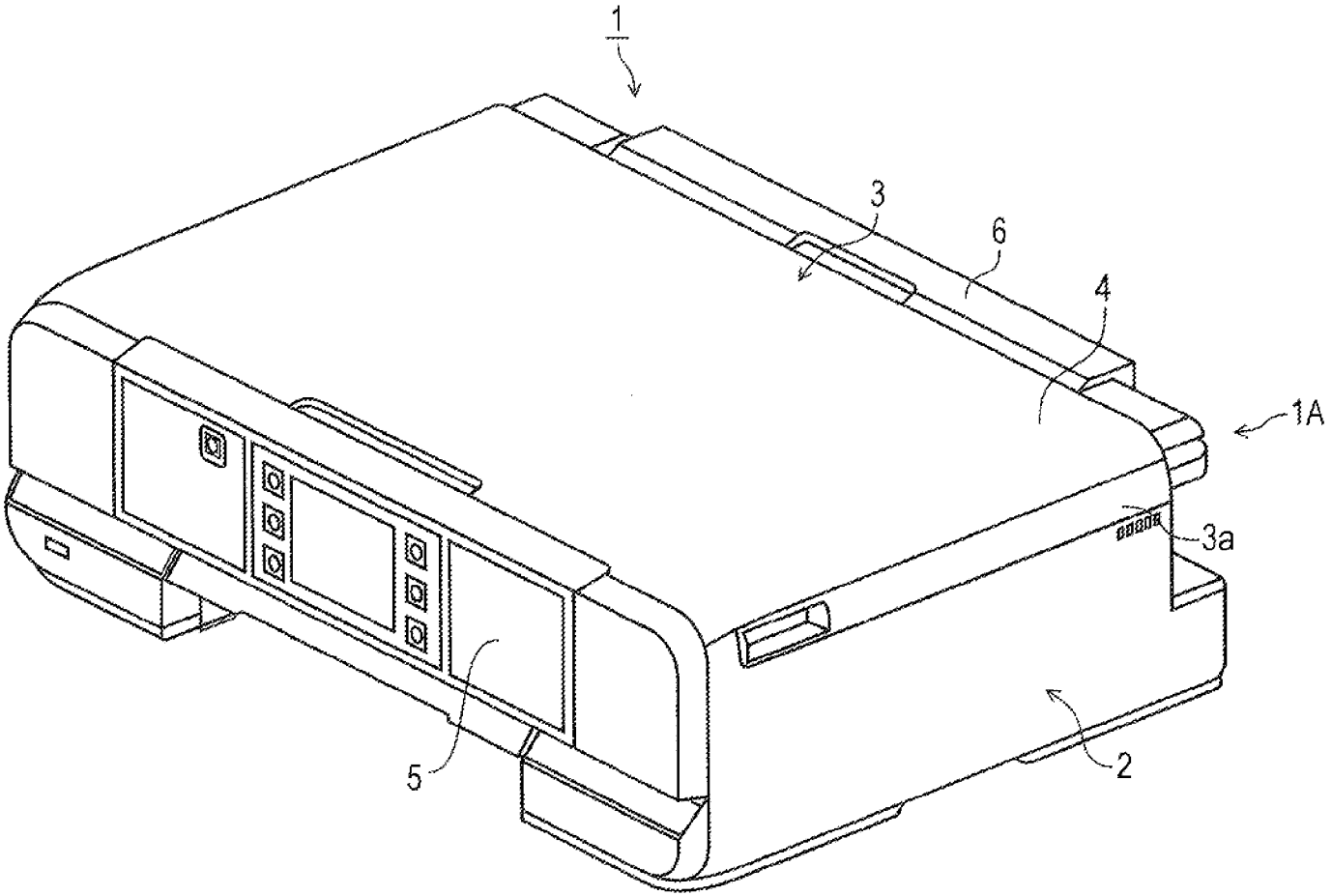
FIG. 1 is an external perspective view of a printer according to the invention, seen from the front.
Figure 2:
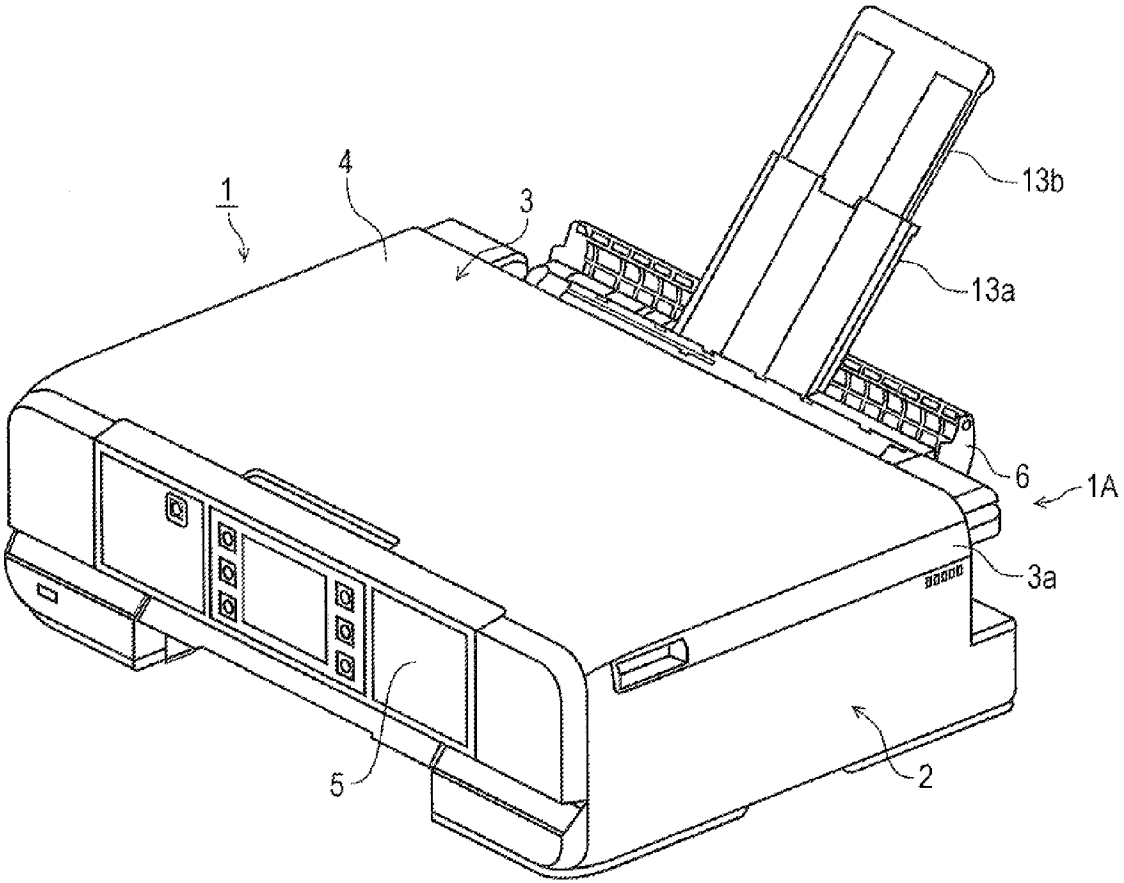
FIG. 2 is an external perspective view of a printer according to the invention, seen from the front.
Figure 3:
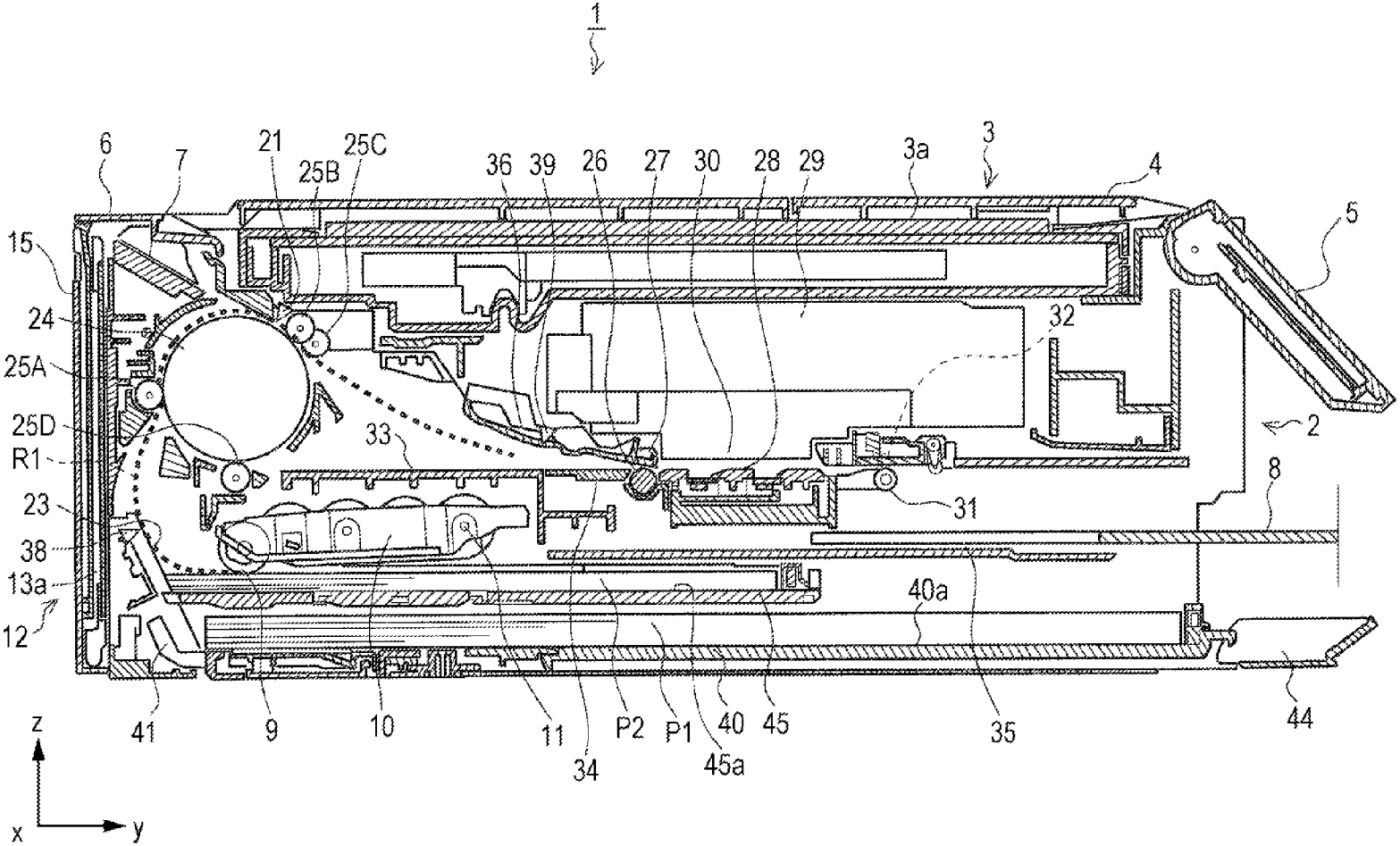
FIG. 3 is a cross-sectional side view illustrating a paper transport path in a printer according to the invention.
Figure 4:
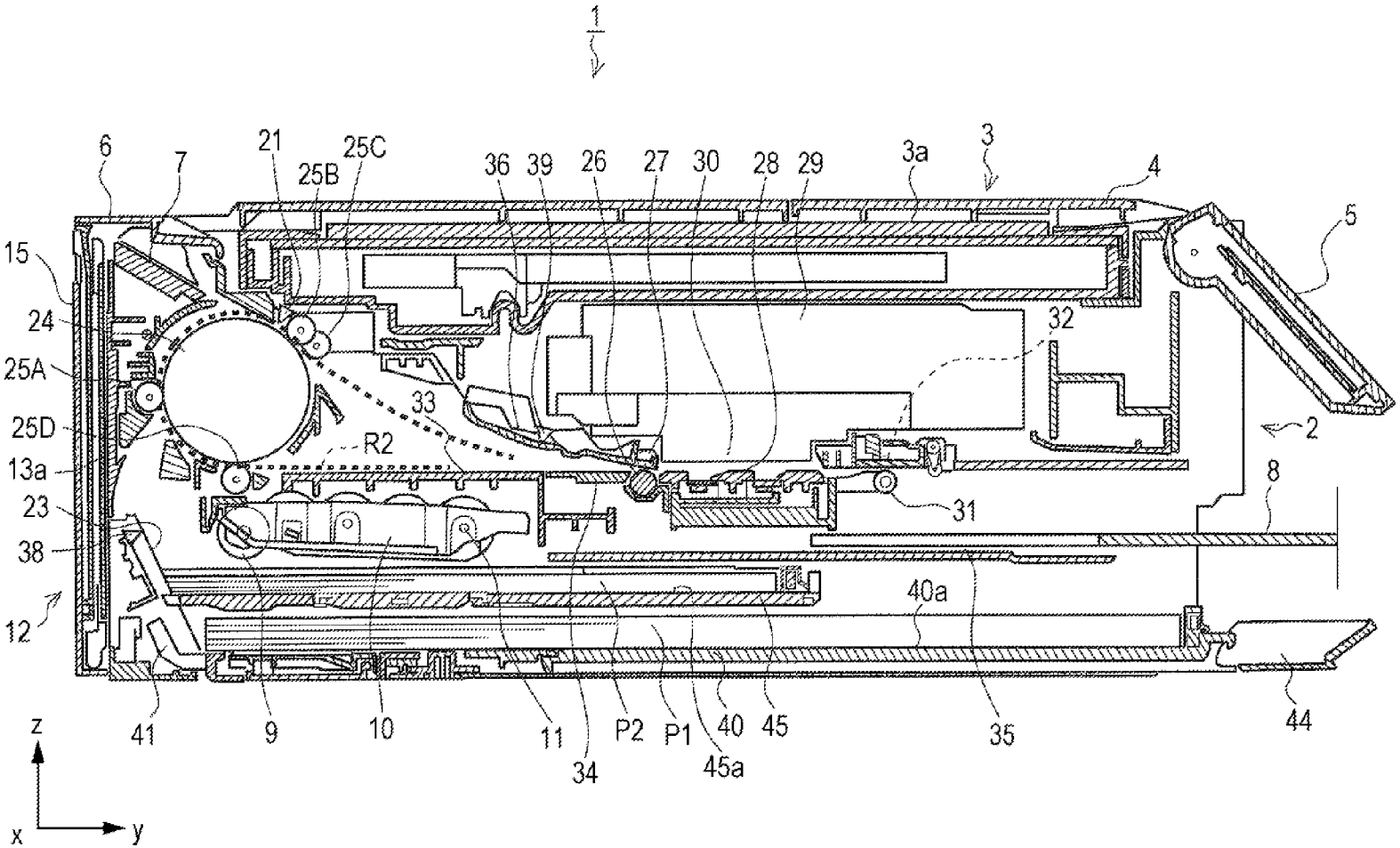
FIG. 4 is a cross-sectional side view illustrating a paper transport path in a printer according to the invention.
Figure 5:
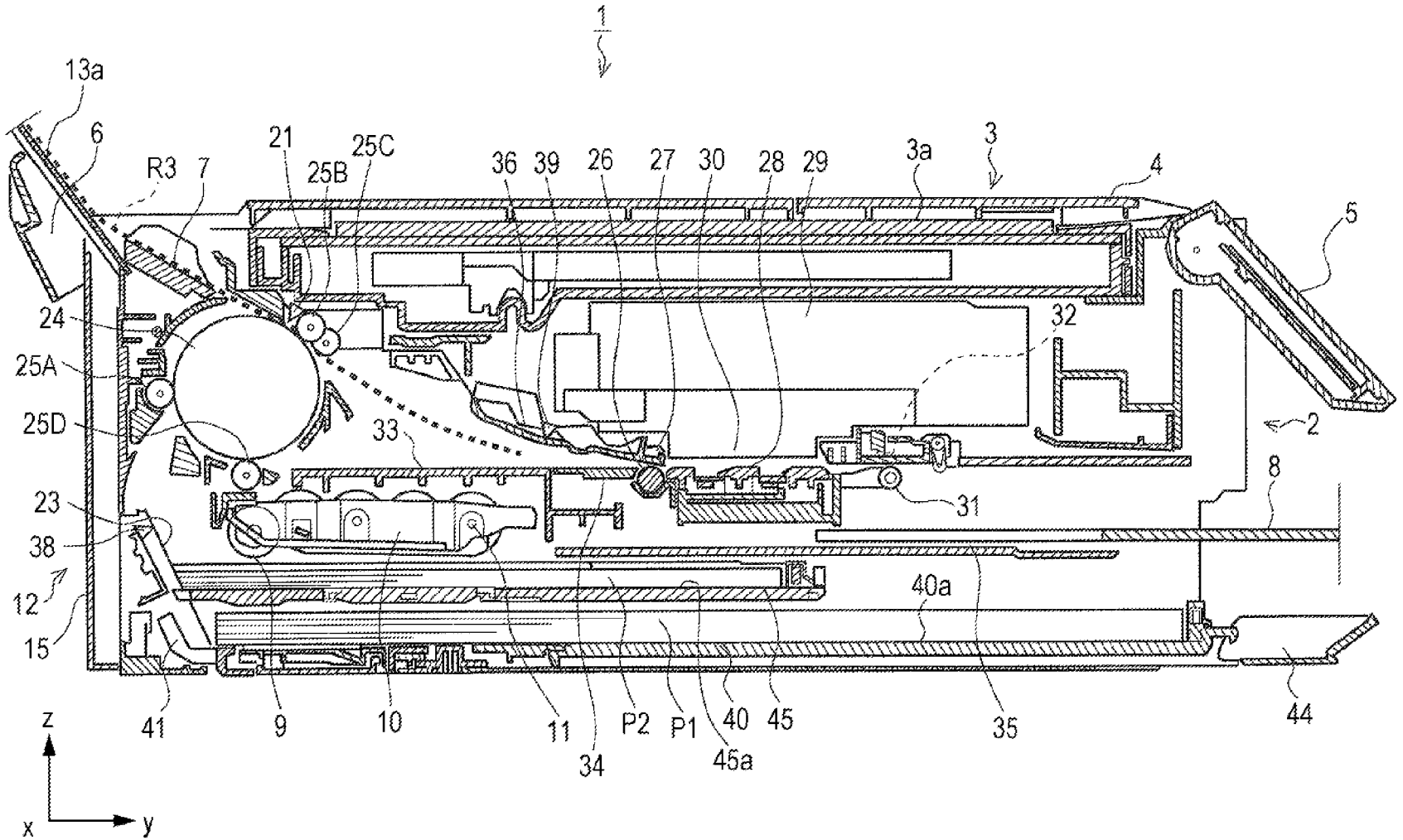
FIG. 5 is a cross-sectional side view illustrating a paper transport path in a printer according to the invention.
Figure 6:
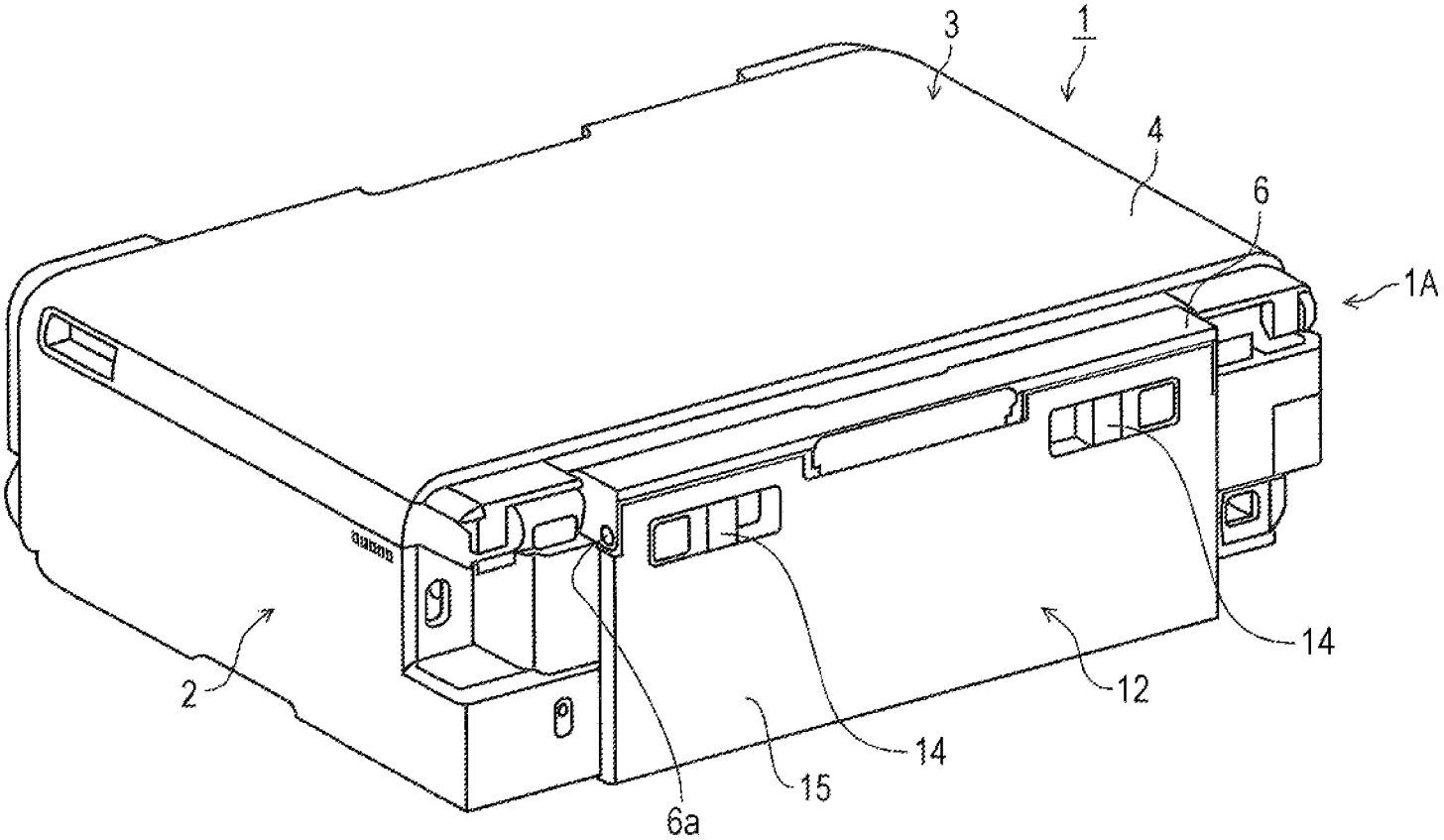
FIG. 6 is an external perspective view of a printer according to the invention, seen from the rear.
Figure 7:
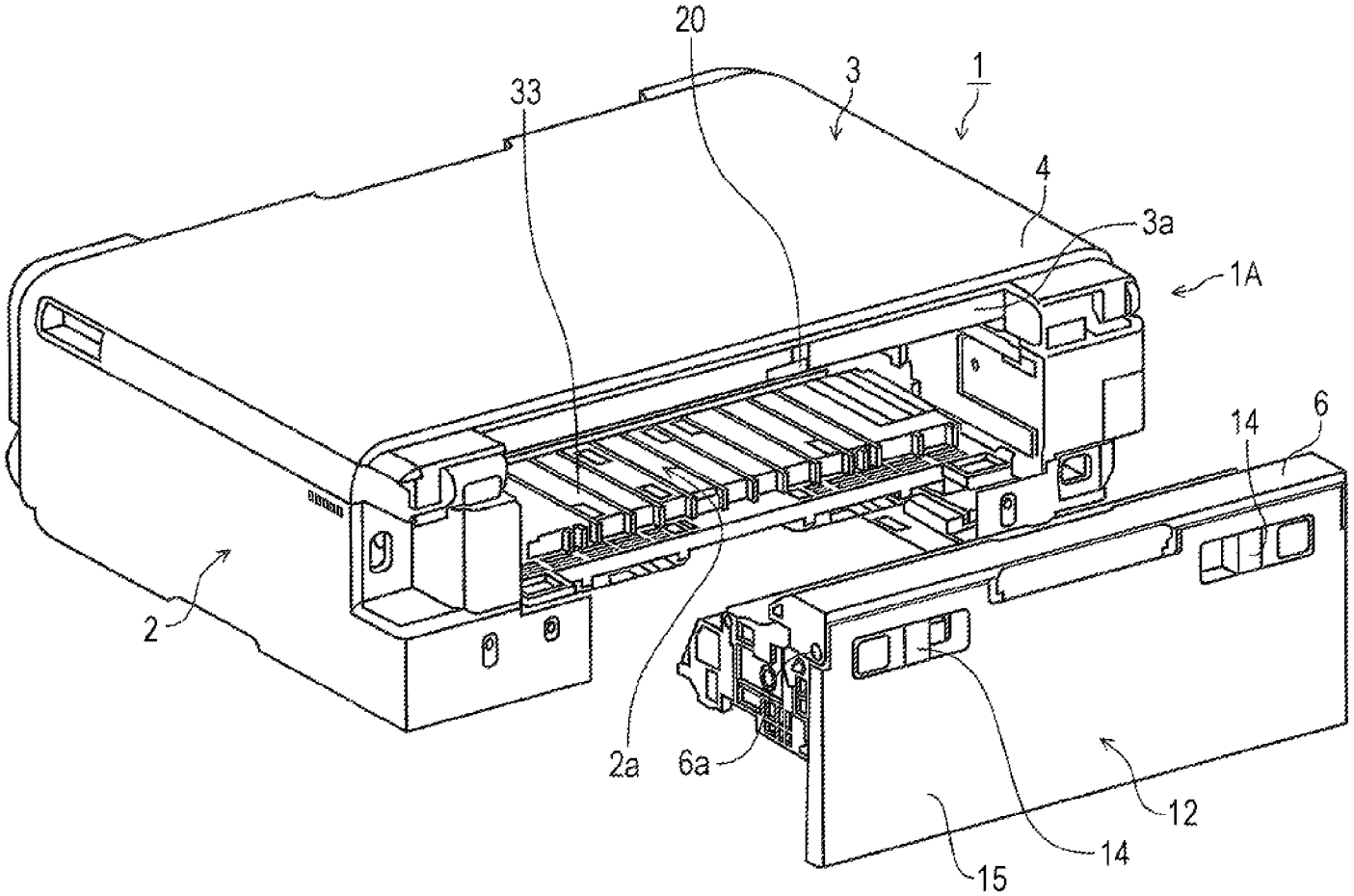
FIG. 7 is an external perspective view of a printer according to the invention with a double-sided printing unit removed, seen from the rear.

FIGS. 1 and 2 are external perspective views of a printer 1 according to the invention, seen from the front; FIGS. 3 to 5 are cross-sectional side views illustrating a paper transport path in the printer 1; FIG. 6 is an external perspective view of the printer 1, seen from the rear; and FIG. 7 is an external perspective view of the printer 1 with a double-sided printing unit 12 removed, seen from the rear.

Figure 8:
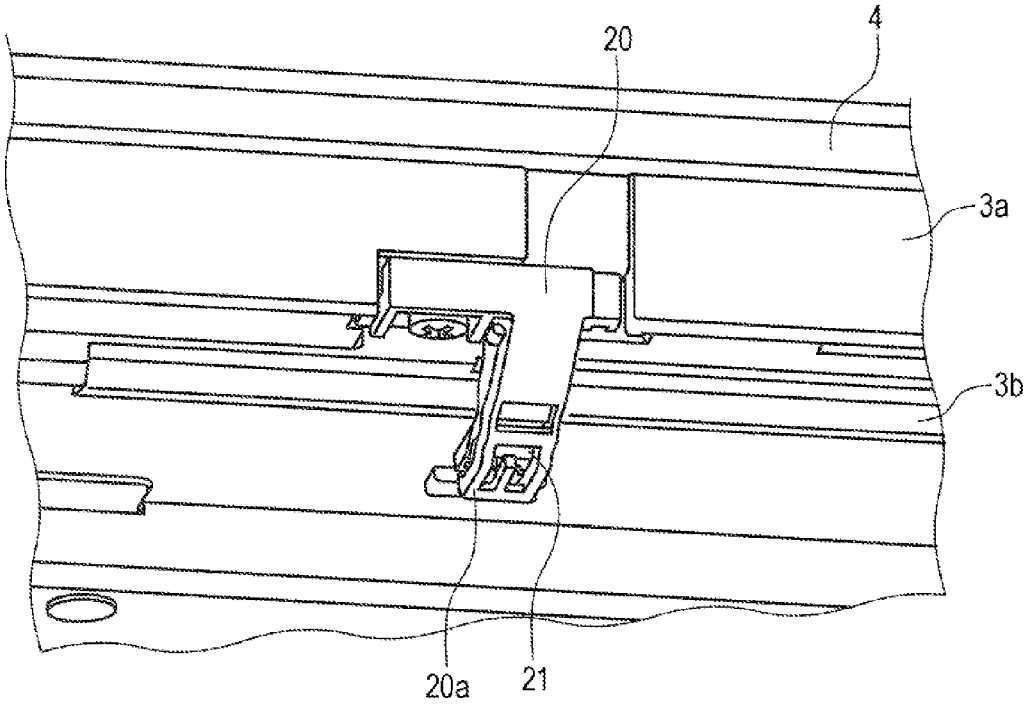
FIG. 8 is a perspective view of an area where a photosensor is attached.
Figure 9:
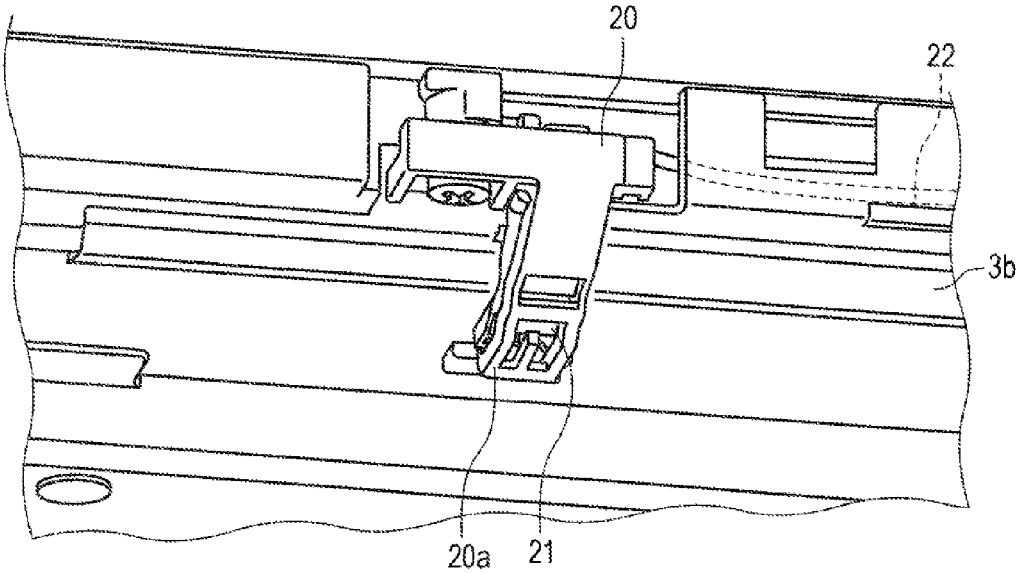
FIG. 9 is a perspective view of an area where a photosensor is attached.
Figure 10:
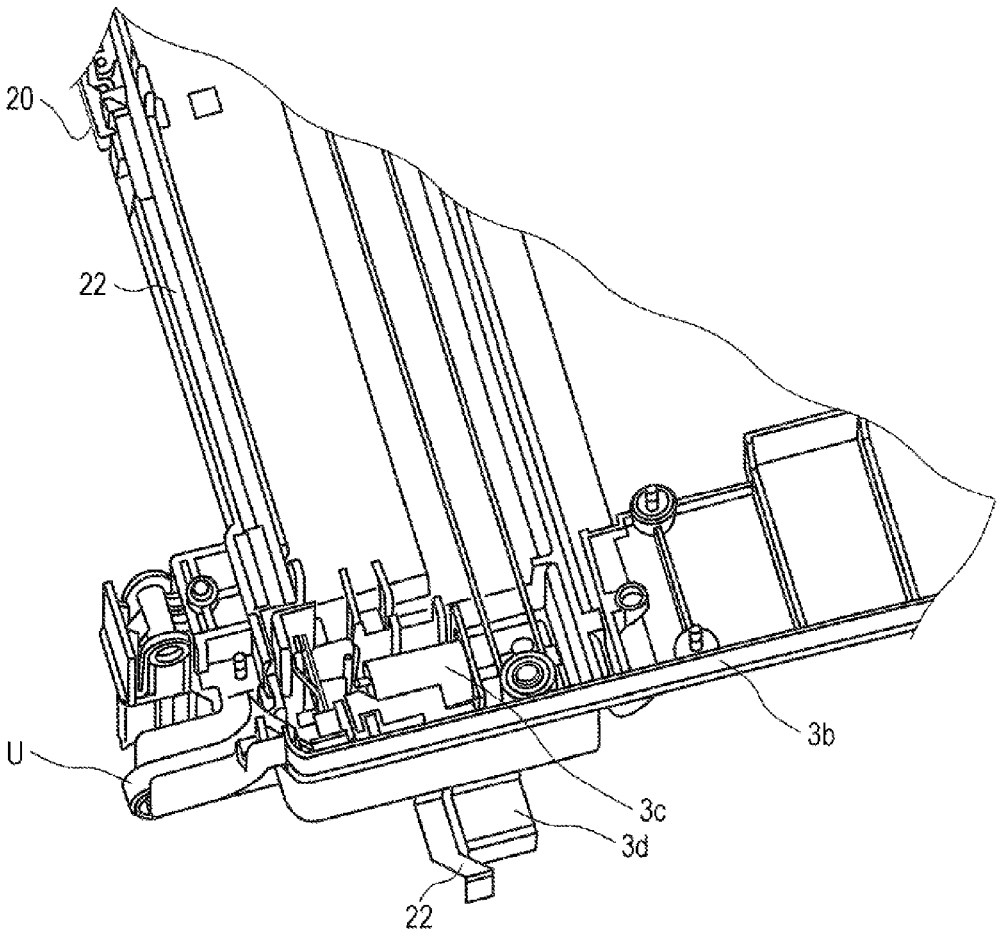
FIG. 10 is a perspective view of a cable pathway seen from above, with an upper housing of a scanner removed.
Figure 11:
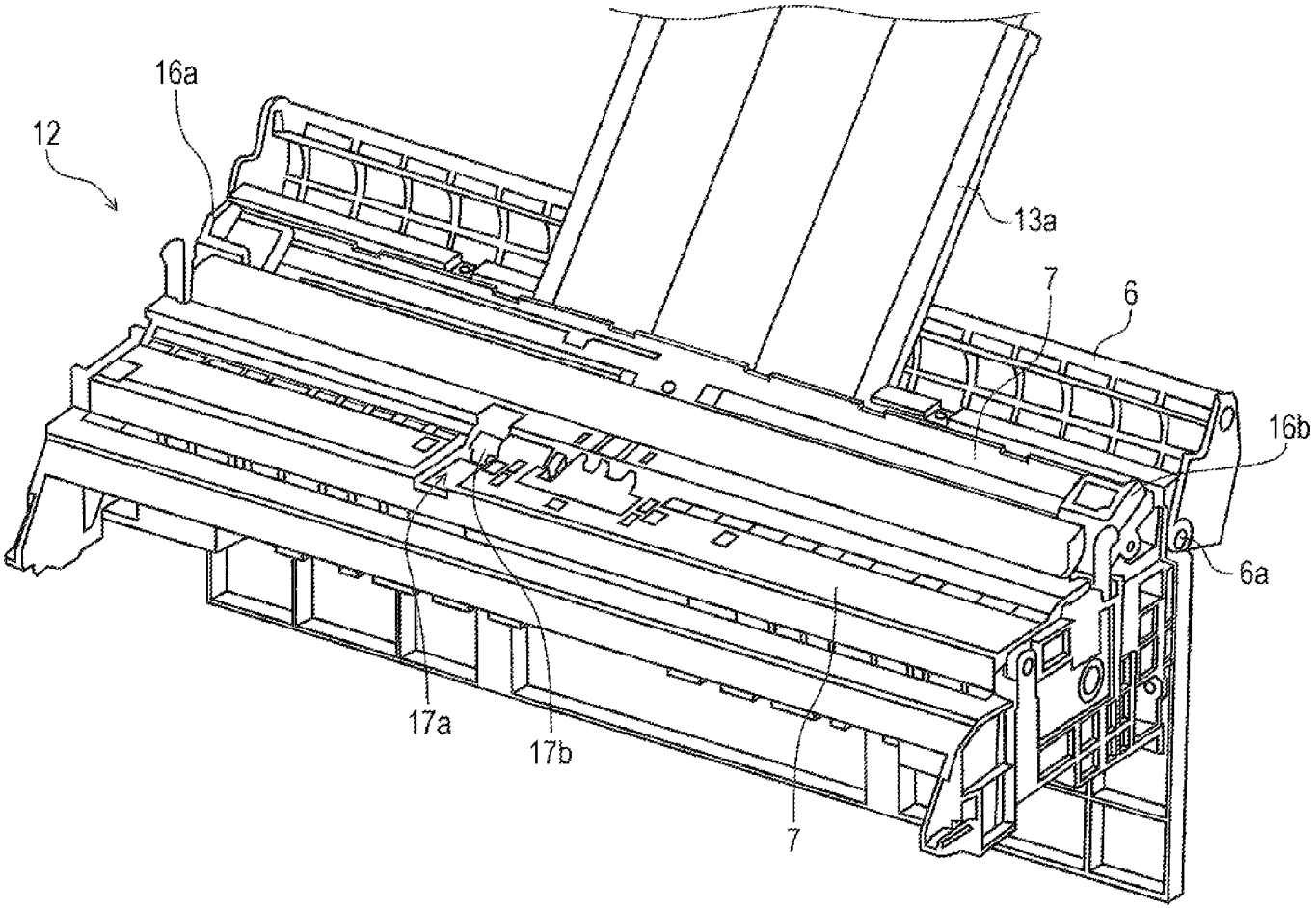
FIG. 11 is a perspective view of a double-sided printing unit.
Figure 12:
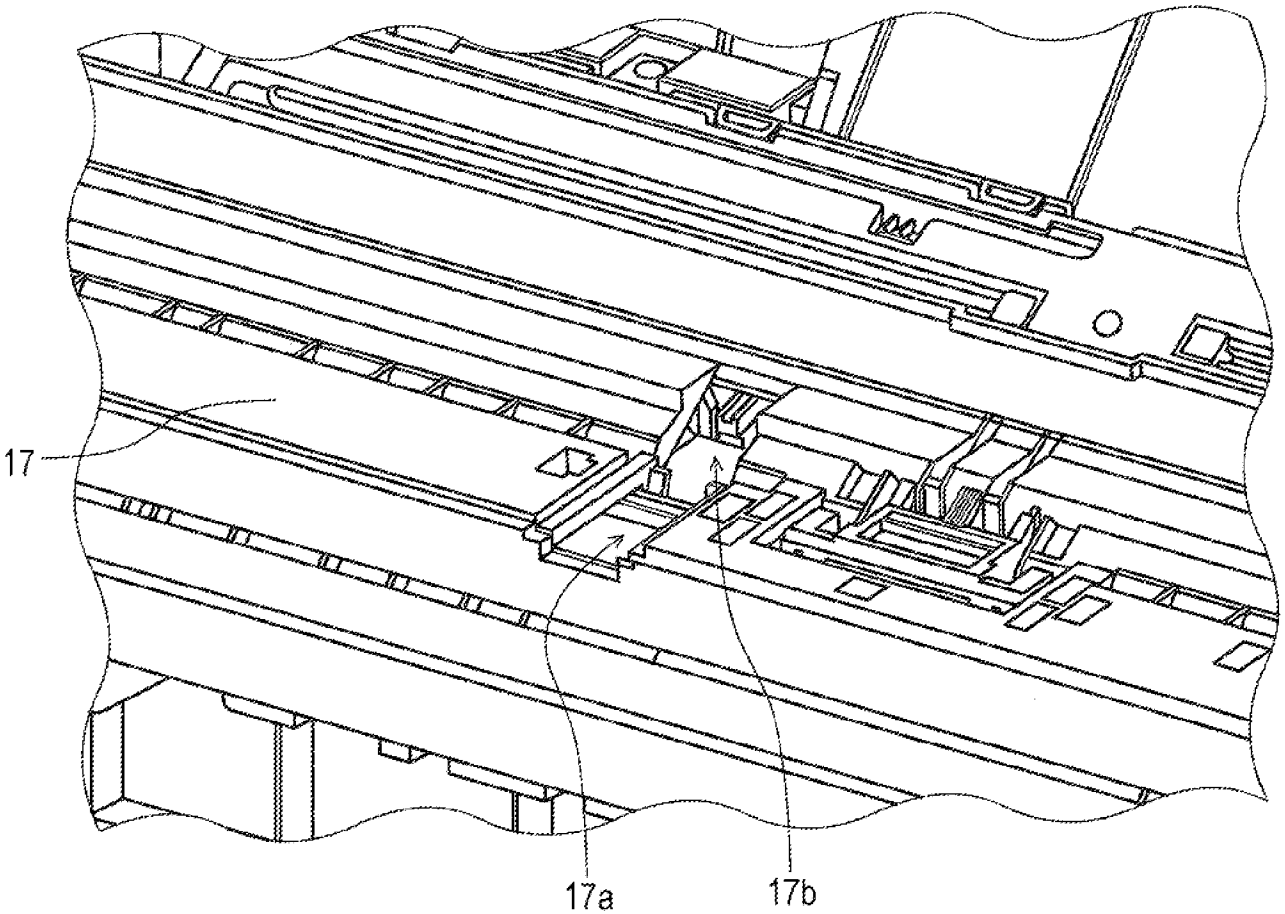
FIG. 12 is a perspective view illustrating a groove and an opening formed in a double-sided printing unit.
Figure 13:
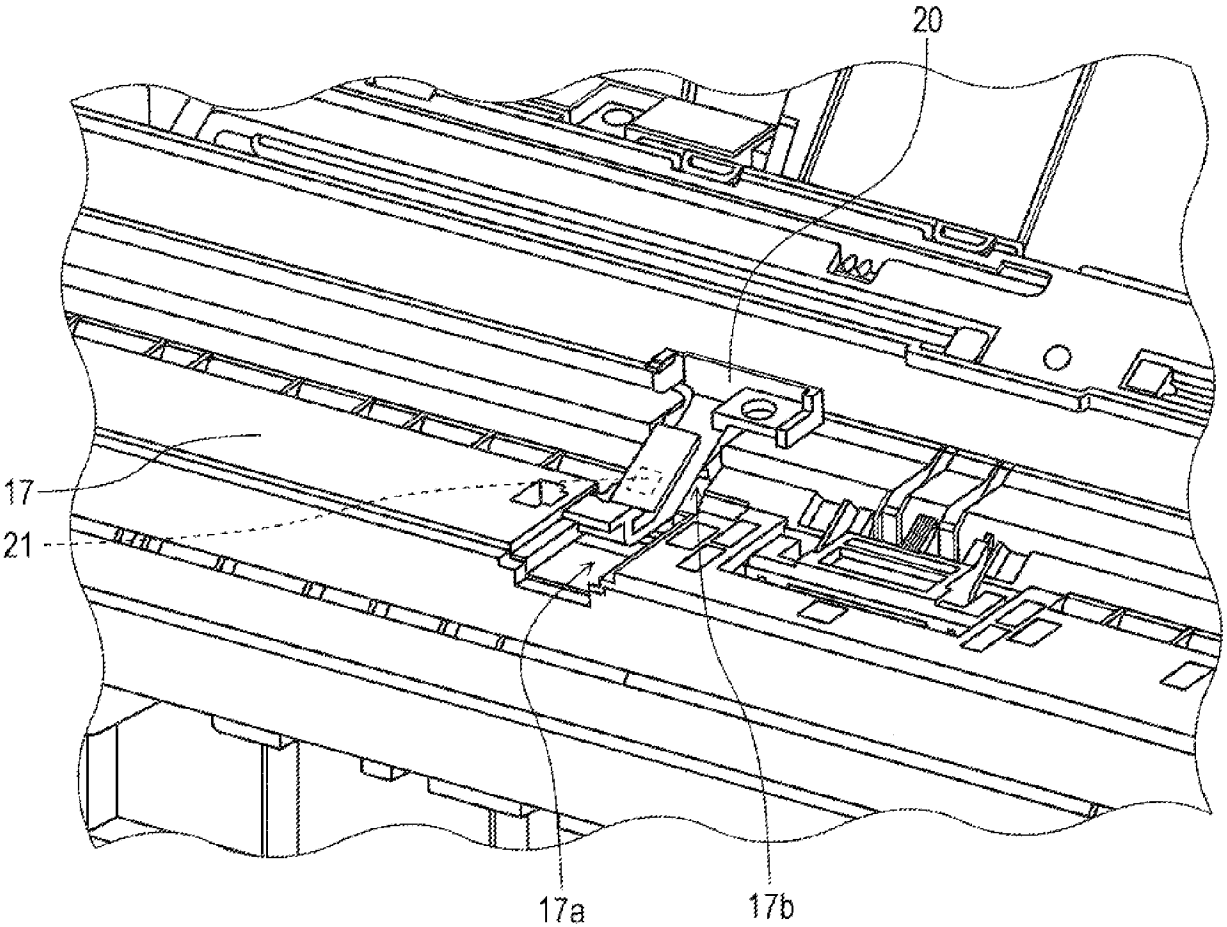
FIG. 13 is a perspective view illustrating a groove and an opening formed in a double-sided printing unit.
Figure 14:
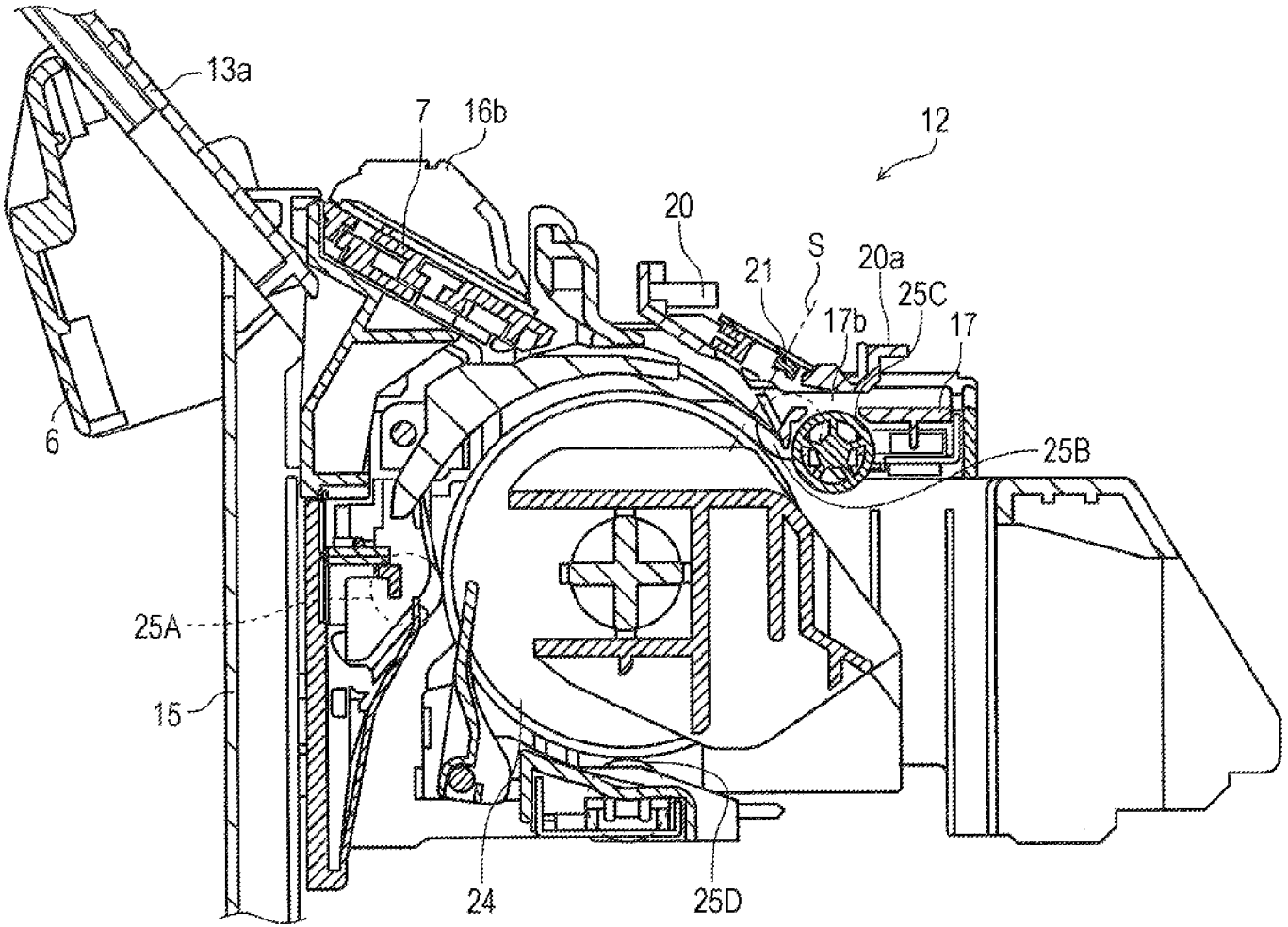
FIG. 14 is a cross-sectional side view of a double-sided printing unit.
Figure 15:
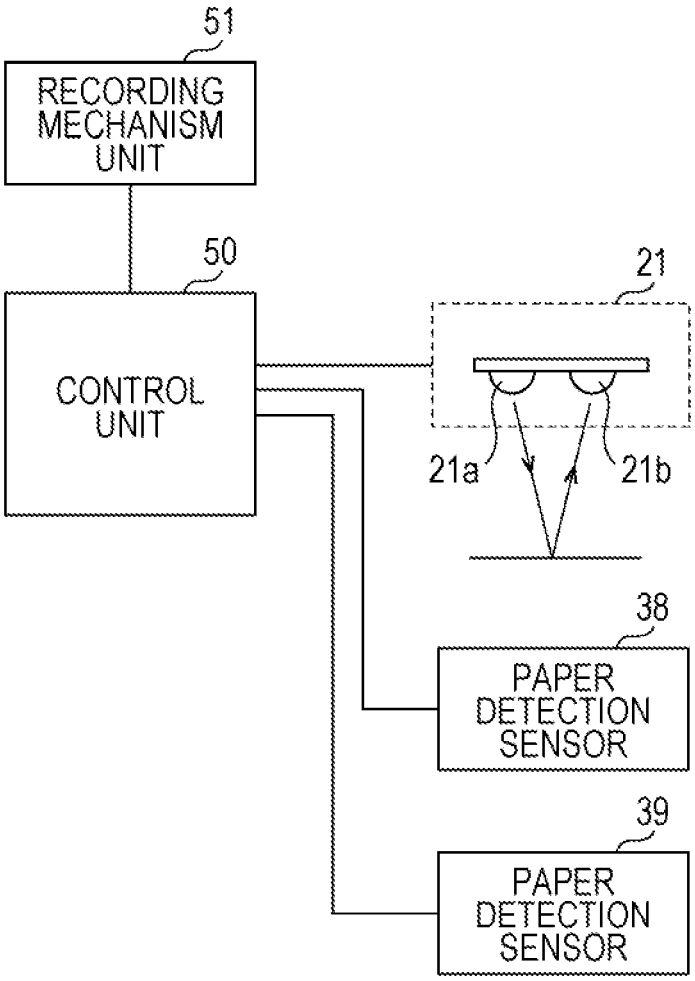
FIG. 15 is a block diagram illustrating part of a control system.

FIGS. 8 and 9, meanwhile, are perspective views of an area where a photosensor is attached; and FIG. 10 is a perspective view of a cable pathway seen from above, with an upper housing 3*a* of a scanner unit 3 removed. Furthermore, FIG. 11 is a perspective view of the double-sided printing unit 12; FIGS. 12 and 13 are perspective views illustrating a groove 17*a* and an opening 17*b* formed in the double-sided printing unit 12; FIG. 14 is a cross-sectional side view of the double-sided printing unit 12; and FIG. 15 is a block diagram illustrating part of a control system.

Hereinafter, the overall configuration of the printer 1 embodying the recording device according to the invention will be described with reference to FIGS. 1 to 5. As shown in FIGS. 1 and 2, the printer 1 includes the scanner unit 3 above a recording section 2 that records onto recording paper, serving as an example of a medium, using the ink jet technique; in other words, the printer 1 is configured as a complex machine that has scanning functionality in addition to ink jet recording functionality.

The scanner unit 3 is provided so as to be capable of pivoting relative to the recording section 2, and can take on a closed state (FIG. 1) or an open state (not shown) by being pivoted.

A cover 4 provided above the scanner unit 3 is a document cover that can be opened and closed, and a document platform 3*a* (shown in FIGS. 3 to 5) of the scanner unit 3 appears when the cover 4 is opened.

Reference numeral 5 indicates a console, provided on the front surface of the apparatus, that includes a power button, operation buttons for making various types of printing settings and executing recording, a display unit for displaying the details of printing settings, a print image preview, and so on.

Reference numeral 6 indicates a manual cover that can be opened and closed, provided in an upper-rear area of the recording section 2; opening the manual cover 6 as shown in FIG. 2 makes it possible to manually feed the recording paper using a manual feed path (mentioned later). When the manual cover 6 is opened, paper supports 13*a* and 13*b*, mentioned later, can be extended. The manual cover 6 is provided so as to be capable of pivoting central to a pivot shaft 6*a* (see FIG. 6) relative to the double-sided printing unit 12, which will be described later.

Next, a paper transport path of the printer 1 will be described in further detail with reference to FIGS. 3 to 5. The printer 1 according to this embodiment includes a lower-level tray 40 and an upper-level tray 45 in a base area of the device, and the recording paper is fed one sheet at a time from the lower-level tray 40 or the upper-level tray 45.

The lower-level tray 40 and the upper-level tray 45, which are capable of holding a plurality of sheets of recording paper, configure a medium holding portion that holds the medium; in other words, the medium holding portion of the printer 1 is configured of a plurality of medium holding trays. The lower-level tray 40 and the upper-level tray 45 provided thereabove are independently removable from the recording section 2. Furthermore, recording paper can be fed from a single mounted tray in the case where one of the trays is not mounted.

In FIGS. 3 to 5, paper held in the lower-level tray 40 is indicated by reference numeral P1 and paper held in the upper-level tray 45 is indicated by reference numeral P2 (however, when there is no particular need to distinguish between the two, the paper will be referred to simply as "paper P").

Note that the upper-level tray 45 slides (displaces) between a contact position, or in other words a feed-capable position (FIGS. 3 to 5), and a retracted position (not shown). In the feed-capable position, the paper P2 can be fed from the upper-level tray 45. In the retracted position, the paper P1 can be fed from the lower-level tray 40.

Reference numeral 44 indicates a cover, provided in the lower-level tray 40, that can be opened and closed; the configuration is such that by opening the cover 44, the lower-level tray 40, the upper-level tray 45, and a discharged paper receiving tray 8 can be exposed on the front surface side of the device, as shown in FIGS. 3 to 5. Note that the cover 44 is not shown in FIG. 1 (because the lower-level tray 40 is removed).

A feed roller (also called a "pickup roller") 9 that is rotationally driven by a driving motor (not shown) and that configures a feed unit is provided on a roller support member 10 that pivots central to a pivot shaft 11, and when the feed roller 9 rotates while in contact with the uppermost sheet of the paper P1 held in the lower-level tray 40 when the upper-level tray 45 is in the retracted position, the uppermost sheet of the paper P1 is fed out from the lower-level tray 40.

Meanwhile, when the upper-level tray 45 is in the contact position (the feed-capable position; see FIG. 3) and the feed roller 9 rotates while in contact with the uppermost sheet of the paper P2 held in the upper-level tray 45, the uppermost sheet of the paper P2 is fed out from the upper-level tray 45.

A separating sloped face 23 is provided in the recording section 2 in a location that opposes the leading end of the lower-level tray 40 and the upper-level tray 45, and when the lower-level tray 40 is mounted, a stopper 41 provided in the leading end of the lower-level tray 40 advances beyond the separating sloped face 23, and the leading end of the paper held in the lower-level tray 40 can make contact with the separating sloped face 23.

Meanwhile, when the upper-level tray 45 is positioned in the feed-capable position, a stopper (not shown) provided in the leading end of the upper-level tray 45 advances beyond the separating sloped face 23, and the leading end of the paper held in the upper-level tray 45 can make contact with the separating sloped face 23.

The leading end of the paper P fed out from the lower-level tray 40 or the upper-level tray 45 advances downstream while making contact with the separating sloped face 23, separating the uppermost sheet of the paper P, which is the sheet to be fed, from the subsequent sheets of the paper P.

Note that a paper detection sensor 38 is provided at the location of the separating sloped face 23 in a paper feed path, and thus the leading end of the paper P fed out from the lower-level tray 40 and the upper-level tray 45 can be detected at this position. Accordingly, the position of the leading end of the paper can be detected and proper feed control can be carried out based thereon regardless of differences in the length of the feed path due to different trays being used to feed paper, differences in the length of the feed path due to more or fewer sheets of paper being held, and so on, or in other words, regardless of differences in the length of the feed path caused by different conditions. Note that in FIGS. 3 to 5, a photosensor 38 and photosensors 21 and 39, which will be mentioned later, are depicted as triangular marks indicating the positions where those sensors are disposed, for the sake of simplicity.

An intermediate roller 24 that is rotationally driven by a motor (not shown) is provided beyond the separating sloped face 23; the paper P is curved and inverted by the intermediate roller 24, and then proceeds toward the front of the device. Note that reference numerals 25A, 25B, and 25C indicate slave rollers that are capable of slave rotation; the paper P is nipped by at least the slave roller 25A and the intermediate roller 24 or by the slave roller 25B and the intermediate roller 24 and is sent downstream.

A transport driving roller 26 that is rotationally driven by a motor (not shown), and a transport slave roller 27 that makes contact with the transport driving roller 26 and undergoes slave rotation and that is supported by a roller support member 36, are provided beyond the intermediate roller 24; the paper P is sent below a recording head 30, which configures a recording unit, by these rollers.

Note that a guide member, indicated by reference numeral 33, is provided below the intermediate roller 24. The guide member 33 forms the paper transport path between the intermediate roller 24 and the transport driving roller 26. Meanwhile, reference numeral 34 indicates a guide member that forms the paper transport path between the guide member 33 and the transport driving roller 26. Furthermore, reference numeral 25D indicates a slave roller that nips the paper P with the intermediate roller 24 when the paper P is switched back in the upstream direction from the transport driving roller 26 (to the left, in FIGS. 2 to 5) for the purpose of double-sided printing.

A paper detection sensor 39 is provided at the location of the roller support member 36 in the paper transport path, and specifically slightly upstream from the paper nip position formed by the transport driving roller 26 and the transport slave roller 27, and the passage of the leading end or following end of the paper P can thus be detected at that location.

The recording head 30 that serves as the recording unit and ejects ink is provided in a base area of a carriage 29, and the carriage 29 is driven by a motor (not shown) so as to move back and forth in a main scanning direction (the thickness direction of the paper in FIGS. 3 to 5).

A support member 28 is provided in a position opposing the recording head 30, and a gap between the paper P and the recording head 30 is defined by the support member 28. A discharge driving roller 31 that is rotationally driven by a motor (not shown) and a discharge slave roller 32 that makes contact with the discharge driving roller 31 and undergoes slave rotation are provided downstream from the support member 28. The paper P that has been recorded onto by the recording head 30 is discharged toward the discharged paper receiving tray 8 by these rollers.

The discharged paper receiving tray 8, which is positioned above the upper-level tray 45, is provided so as to be capable of being set, by a motor (not shown), to a state stored within the recording section 2 (not shown) and a state protruding forward from the recording section 2 (FIGS. 3 to 5), and can receive the recording paper that has been recorded onto and discharged by taking on the state protruding forward from the recording section 2.

The feed roller 9, the intermediate roller 24, the transport driving roller 26, the carriage 29, the recording head 30, and the discharge driving roller 31, which are subject to control, configure a recording mechanism unit 51 that is controlled by a control unit 50, shown in FIG. 15. The control unit 50 can detect the position of the paper, the size of the paper, and so on based on detection signals received from the respective detection units, namely the paper detection sensors 38, 21, and 39, disposed in respective locations of the paper transport path. Furthermore, in the case where a paper jam has occurred, the control unit 50 can detect which paper detection sensor detects the paper jam. Accordingly, appropriate alerts can be issued to a user.

Note that the paper detection sensors 38, 21, and 39 are photosensors in this embodiment. Describing the configuration of the paper detection sensor 21 as an example, as shown in FIG. 15, the photosensor 21 includes a light-emitting portion 21*a* and a light-receiving portion 21*b*; the light-emitting portion 21*a* emits detection light toward the paper, and the light-receiving portion 21*b* receives components of the light reflected by the paper or the paper transport path.

The control unit 50 of the printer 1 can detect the passage of the leading end or the following end of the paper by receiving, from the photosensor 21, a signal indicating the optical intensity of the light received by the light-receiving portion 21*b*. Accordingly, an area of the paper transport path that opposes the photosensor 21 is colored black, for example, so that the reflectance thereof differs significantly from the paper.

Although the foregoing has described the primary constituent elements of the paper transport path, the paper transport path includes an inverting transport path that inverts the paper P after recording has been carried out on the first surface (the front surface) thereof (indicated by a broken line R2 in FIG. 4) and a manual feed path through which paper is fed manually via a manual guide portion 7 (indicated by a broken line R3 in FIG. 5) in addition to the paper transport path along which the paper P that has been fed out from the lower-level tray 40 or the upper-level tray 45 is transported (indicated by a broken line R1 in FIG. 3).

The inverting transport path R2 is a transport path used when the transport driving roller 26 is driven in reverse, the end of the paper that was the following end during recording becomes the leading end and is transported toward the intermediate roller 24 and the slave roller 25D, and the paper is inverted by the intermediate roller 24 and is fed once again between the transport driving roller 26 and the transport slave roller 27.

The manual feed path R3 is a feed path formed by the manual guide portion 7 that is exposed when the manual cover 6 in an upper-rear area of the device is opened and the paper supports 13*a* and 13*b* that support the paper P guided by the manual guide portion 7.

Part of the manual feed path R3 is formed from the double-sided printing unit 12, which serves as a unit member. The double-sided printing unit 12 also forms the inverting transport path R2. The double-sided printing unit 12 will be described in further detail below.

The double-sided printing unit 12 is configured so as to be removable from a device main body 1A that includes the recording section 2 and the scanner unit 3. Accordingly, paper that has jammed in the double-sided printing unit 12 can be removed with ease. As shown in FIGS. 6 and 7, the double-sided printing unit 12 is provided toward a rear surface of the device main body 1A, and configures the rear surface of the device main body 1A when in a mounted state.

Lock release tabs 14 are provided on both sides of an upper area of a rear plate 15 that configures the rear surface of the double-sided printing unit 12. By sliding these two lock release tabs 14 toward each other, the locking action of a lock mechanism (not shown), or in other words, a mechanism that locks the double-sided printing unit 12 to the device main body 1A, is released, and the double-sided printing unit 12 can be removed as shown in FIG. 7.

In FIG. 7, reference numeral 2*a* indicates a mounting region in the device main body 1A where the double-sided printing unit 12 is mounted. Removing the double-sided printing unit 12 exposes the aforementioned guide member 33. In other words, the paper transport path is exposed. Because the guide member 33 is shared by all three paper transport paths, removing the double-sided printing unit 12 exposes a transport path area shared by the three paper transport paths.

The double-sided printing unit 12 includes the manual cover 6, the intermediate roller 24, the slave rollers 25A to 25D, the manual guide portion 7, the rear plate 15, and the paper supports 13*a* and 13*b*. The paper supports 13*a* and 13*b* are contained on an inner side of the rear plate 15, and can be pulled out in the vertical direction. The paper support 13*b* is nested within the paper support 13*a*, and can be pulled out therefrom in the vertical direction. The paper support 13*a* takes on a tilted orientation when pulled out, as shown in FIGS. 2 and 14, and supports the paper P that is manually fed.

As shown in FIG. 11, edge guides 16*a* and 16*b* are provided on both sides of the manual guide portion 7 in the width direction thereof, and the paper supported by the manual guide portion 7 and the paper supports 13*a* and 13*b* is guided on both side edges by the edge guides 16*a* and 16*b*.

Next, the mounting region 2*a* where the double-sided printing unit 12 is mounted will be described. An area above the entry to the mounting region 2*a* is configured by the scanner unit 3, and a sensor attachment member 20 for attaching the photosensor 21 is provided in a center area in the width direction thereof.

As shown in FIGS. 8 and 9, the sensor attachment member 20 is attached to a lower housing 3*b* of the scanner unit 3, and the photosensor 21 is attached to a leading end portion 20*a* of the sensor attachment member 20. The photosensor 21 emits detection light toward the mounted double-sided printing unit 12 and receives reflected light via an opening formed in the leading end portion 20*a* of the sensor attachment member 20. In the sensor attachment member 20, the leading end portion 20*a* protrudes toward the mounting region 2*a* of the double-sided printing unit 12, or in other words, at least part of the area that configures the photosensor 21 protrudes toward the mounting region 2*a*.

FIG. 9 illustrates a state in which the document cover 4 and the upper housing 3*a* of the scanner unit 3 have been removed from the state shown in FIG. 8, and a flexible flat cable ("FFC" hereinafter) 22, which serves as a signal line from the position where the photosensor 21 is attached, runs toward the right in FIG. 9. In FIG. 10, reference numeral 3*c* indicates a motor that drives an image sensor (not shown) of the scanner unit 3 in a scanning direction thereof. A flexible flat cable ("FFC" hereinafter) 3*d* for sending electrical signals for driving the motor 3*c* and read-out data to be sent from the image sensor (not shown) to the control unit 50 extends downward from the scanner unit 3, and runs to a circuit board (that configures the control unit 50) provided within the device main body 1A. Note that FIG. 10 shows only part of the scanner unit 3, and does not show the device main body 1A.

The FFC 22 running from the position where the photosensor 21 is attached merges with the FFC 3*d* and is connected to the control unit 50 within the device main body 1A along with the FFC 3*d*. In other words, the FFC 22 is disposed using the pathway of the FFC 3*d* that electrically connects the scanner unit 3 to the device main body 1A, and thus a dedicated pathway for disposing a signal line from the photosensor 21 is unnecessary, making it possible to avoid complicating the device configuration and to increase the ease of assembly of the device.

Next, as shown in FIGS. 11 to 14, the groove 17*a* and the opening 17*b* are provided in an upper cover 17 that is provided in an upper area of the double-sided printing unit 12.

The opening 17*b* is an opening that opposes the photosensor 21 when the double-sided printing unit 12 is mounted in the device main body 1A, and the photosensor 21 can detect the paper P passing through the paper transport path within the double-sided printing unit 12 via this opening 17*b*.

In other words, the photosensor 21, which serves as a first detection unit that detects paper transported within the double-sided printing unit 12, is not provided in the double-sided printing unit 12, and is instead provided in the device main body 1A; accordingly, it is not necessary to provide an electrical contact between the double-sided printing unit 12 and the device main body 1A, making it possible to improve the reliability of the device.

Furthermore, because the photosensor 21 is provided in the device main body 1A, it is not necessary to make space for providing the photosensor 21 in the double-sided printing unit 12. Accordingly, an increase in the height dimension of the device main body 1A can be avoided, particularly compared to a configuration in which the photosensor 21 is provided in an upper area of the double-sided printing unit 12.

In other words, although it is preferable to provide a cover over the photosensor 21 in order to protect the photosensor 21 in the case where the photosensor 21 is provided in an upper area of the double-sided printing unit 12, providing such a cover makes it necessary to also provide a region for receiving the cover above the mounting region 2*a* for the double-sided printing unit 12 in the device main body 1A. Furthermore, because the scanner unit 3 is provided above the device main body 1A, such a region for receiving the cover will interfere with the region occupied by the scanner unit 3, which will ultimately lead to an increase in the size of the device. However, according to this embodiment, the photosensor 21 is provided in the device main body 1A as described above, and thus such an increase in the size of the device can be avoided.

In addition, according to this embodiment, the double-sided printing unit 12 includes the manual guide portion 7, which serves as a medium support surface that supports at least part of the paper before the paper is fed, and when the double-sided printing unit 12 is mounted in the device main body 1A, the manual feed path R3 for the paper fed to the recording head 30 via the manual guide portion 7 is formed. Accordingly, removing the double-sided printing unit 12 exposes the manual feed path R3 as well, making operations for clearing paper jams easier.

Meanwhile, although the leading end portion 20*a* of the sensor attachment member 20 protrudes toward the mounting region 2*a* for the double-sided printing unit 12 in the device main body 1A, the groove 17*a*, which receives the leading end portion 20*a* of the sensor attachment member 20, is formed in an upper area of the double-sided printing unit 12, following the direction along which the double-sided printing unit 12 is mounted and removed. FIGS. 13 and 14 illustrate the sensor attachment member 20 that is actually attached to the device main body 1A along with the double-sided printing unit 12 for descriptive purposes, and illustrate a positional relationship between the double-sided printing unit 12 and the device main body 1A when the former is mounted in the latter.

As shown in FIGS. 13 and 14, when the double-sided printing unit 12 is mounted in the device main body 1A, the leading end portion 20*a* of the sensor attachment member 20 passes through the groove 17*a*, and when the double-sided printing unit 12 is in a mounted state, the photosensor 21 provided in the leading end portion 20*a* faces the opening 17*b* in the double-sided printing unit 12.

Due to the relationship between the leading end portion 20*a* of the sensor attachment member 20 and the groove 17*a*, the leading end portion 20*a* and the groove 17*a* engaging with each other act to guide the mounting of the double-sided printing unit 12 when the double-sided printing unit 12 is mounted. This enables the double-sided printing unit 12 to be mounted in the proper position.

Furthermore, according to this embodiment, the detection unit that detects the paper in the double-sided printing unit 12 is the photosensor 21, which includes the light-emitting portion 21*a* that emits detection light toward the opening 17*b* and the light-receiving portion 21*b* that receives reflected light from the opening 17*b*, or in other words, is a non-contact detection unit; the configuration does not drop a detection lever into the paper transport path via the opening 17*b*, eliminating a risk of the photosensor 21 being damaged when the double-sided printing unit 12 is mounted or removed.

A paper detection position of the photosensor 21 will be described next. The photosensor 21 detects the paper at a position that is upstream in the paper feed direction from the roller pair that nips the paper furthest upstream in the manual feed path R3 that feeds paper via the manual guide portion 7, or in other words, upstream in the paper feed direction from the intermediate roller 24 and the slave roller 25B. In FIG. 14, a line S indicates the paper detection position of the photosensor 21.

Through this, the following effects are achieved. There is a risk that thin, flimsy paper cannot pass the position of the nip formed by the roller pair and cannot be fed as a result. However, the photosensor 21 detects the paper at a position that is upstream in the paper feed direction from the roller pair furthest upstream in the manual feed path R3 that feeds paper via the manual guide portion 7, and thus the paper can be detected with certainty even in the case where thin, flimsy paper is fed.

If the intermediate roller 24 is then driven based on the paper detection, the paper can be fed downstream with certainty, and thus even thin, flimsy paper can be fed with certainty.

Note that when the photosensor 21 detects paper in the manual feed path R3, the control unit 50 in the device can notify a user of the paper detection using sound, light, or another type of user interface (a printer driver running on a computer or a display panel provided in the console 5). This can give the user a sense of ease that the paper has been loaded without any problems.

Meanwhile, in the case where, for example, it is not appropriate for paper to be loaded from the manual feed path R3, such as the case where, for example, paper is loaded via the manual feed path R3 while recording is being executed (and the following end of the paper currently being recorded onto has passed the photosensor 21) and that paper has been detected by the photosensor 21, the control unit 50 can interrupt the operations for transporting the paper. Through this, the loaded paper can be prevented from being fed into the transport path through the rotation of the intermediate roller 24.

Furthermore, in addition to interrupting the paper transport operations, an error message, a message prompting the loaded paper to be removed, and so on can be issued to the user through the aforementioned user interface.

A variety of variations can be made on the aforementioned embodiment. For example, although the aforementioned opening 17*b* is described as having a hole form, the opening 17*b* may instead have a cutout shape (where at least one side is open). Alternatively, the opening 17*b* may be a transparent window portion. As long as the sensor 21 is an optical sensor, paper located below such a transparent window portion can be detected.

In addition, in this embodiment, a lever-type detection unit that pivots in response to the insertion of paper may be used as the detection unit for detecting paper within the double-sided printing unit 12 instead of the photosensor 21. According to this configuration, there is no risk of a drop in detection performance due to the sensor portion becoming soiled.

Figure 16:
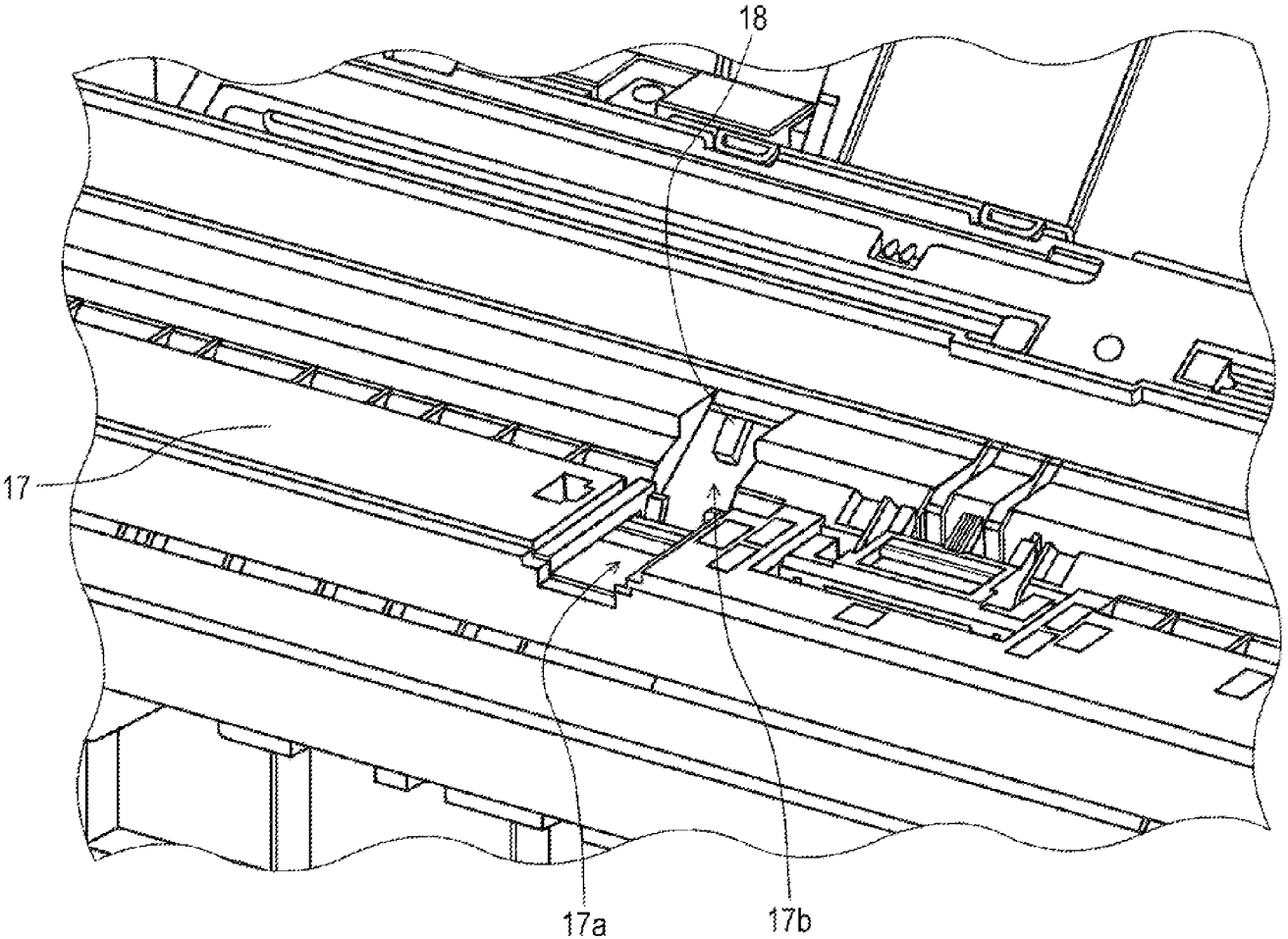
FIG. 16 is a perspective view illustrating a groove and an opening formed in a double-sided printing unit.

Meanwhile, the double-sided printing unit 12 can be configured as shown in FIG. 16. In FIG. 16, reference numeral 18 indicates a biasing portion that biases the recording paper passing below the opening 17*b* toward the outside of the opening 17*b*. Because the recording paper passing below the opening 17*b* is biased toward the outside of the opening 17*b* by the biasing portion 18 in this manner, the position at which the recording paper passes relative to the opening 17*b* does not easily vary, or in other words, the distance between the photosensor 21 and the recording paper does not easily vary, and thus the recording paper that passes the position of the opening 17*b* can be properly detected by the photosensor 21.

Furthermore, the recording head that carries out recording may be a fixed type, or what is known as a line-head type, instead of the type that is moved back and forth by a carriage.

A supply source of ink, which serves as a liquid ejected from the recording head, may be an ink cartridge mounted in the carriage, or may be an ink receptacle provided off the carriage. The ink receptacle provided off the carriage may be provided within the housing that configures the outside of the recording device, or may be provided outside of the housing. Although the type in which the ink cartridge is mounted in the carriage is limited in terms of the ink capacity within the cartridge, providing the ink receptacle off the carriage makes it possible to increase the ink capacity and by extension execute a higher number of recordings.

Note that when supplying ink to the recording head from the outside of the housing, it is necessary to bring an ink supply tube for supplying the ink into the housing. Accordingly, it is preferable to provide a hole, a cutout, or the like in the housing and pass the ink supply tube through that hole, cutout, or the like. Alternatively, a boss that prevents constituent elements that open and close relative to the housing, such as the scanner unit that can be opened and closed relative to the housing, covers, or the like from completely closing may be provided, and the tube may be brought into the housing a gap formed by the boss. Doing so makes it possible to ensure a supply of ink through the flow channel formed by the ink supply tube.

Figure 17:
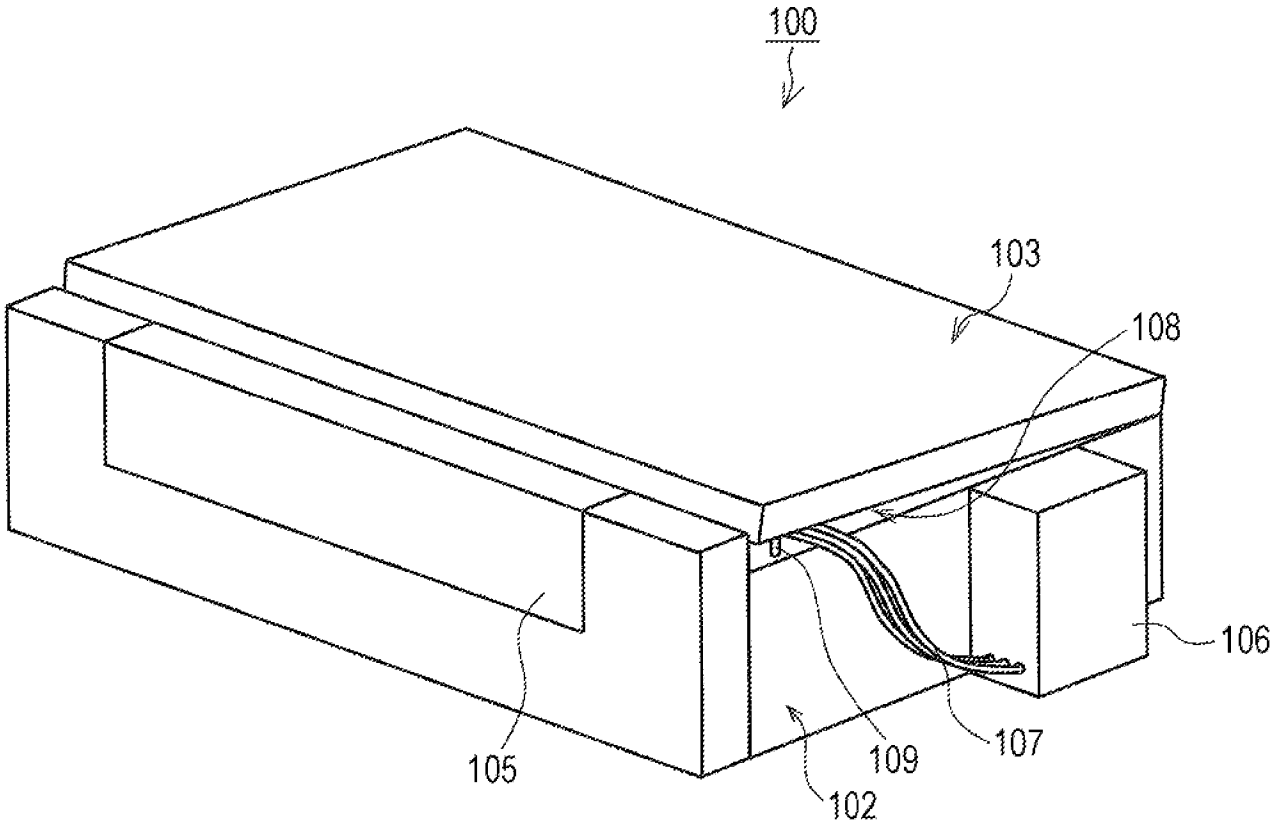
FIG. 17 is a perspective view schematically illustrating a printer according to another embodiment.

FIG. 17 illustrates an example thereof, and is a perspective view schematically illustrating a printer according to another embodiment. In FIG. 17, reference numeral 100 indicates an ink jet printer, reference numeral 102 indicates a recording unit, reference numeral 103 indicates a scanner unit that can be opened and closed relative to the recording unit 102, reference numeral 105 indicates a console unit (on a front surface side of the device), reference numeral 106 indicates an ink receptacle, and reference numeral 107 indicates an ink supply tube that supplies ink from the ink receptacle 106 to a recording head (not shown in FIG. 17). A boss (a projection) 109 is provided on an upper portion of the recording unit 102; due to the boss 109, the scanner unit 103 cannot completely close relative to the recording unit 102, resulting in a gap 108 being formed.

The ink supply tube 107 enters into the printer from the gap 108, and as a result the configuration is such that the scanner unit 103 does not block the ink flow channel formed by the ink supply tube 107. Using the ink receptacle 106 provided off the carriage in this manner makes it possible to increase the ink capacity and by extension execute a higher number of recordings.

Figure 18:
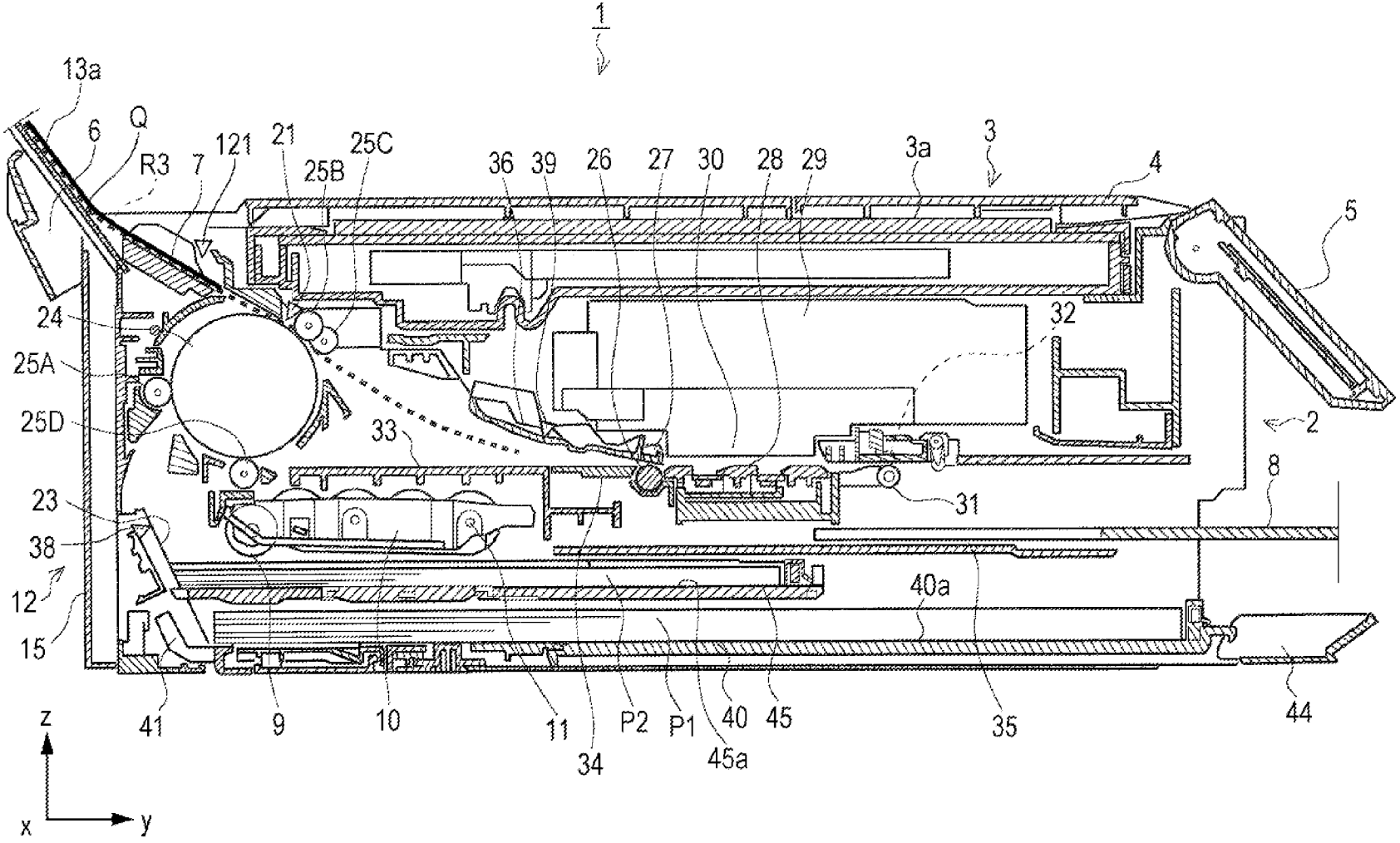
FIG. 18 is a cross-sectional side view illustrating a paper transport path in a printer according to another embodiment.

Furthermore, as shown in FIG. 18, a photosensor 121 that is different from the photosensor 21 may be provided upstream from a location in the manual feed path R3 that merges with the intermediate roller 24. Like the photosensor 21, the photosensor 121 is provided in the device main body 1A. For the sake of simplicity, the location where the photosensor 121 is disposed is indicated by a triangular mark.

According to this configuration, in the case where a user has mistakenly inserted paper Q from the manual feed path R3 when the paper P fed from the lower-level tray 40 or the upper-level tray 45 is transported downstream, a warning can be issued to the user, the rotation of the intermediate roller 24 can be stopped, or both when the leading end of the paper Q passes the photosensor 121. As a result, paper jams caused by the paper P and the paper Q colliding can be prevented, the paper P and the paper Q can be prevented from being fed at the same time, and so on. Note that the sensor 121 is not limited to a photosensor; any sensor capable of detecting the passage of paper may be used, including, for example, a lever-type detection unit that pivots.

Meanwhile, any method that catches the attention of the user may be used as the method for issuing a warning to the user, such as a voice, a warning sound, a message displayed in a monitor, causing an LED or the like to blink, vibration, or the like. For example, in the case where the user has been prompted to pull the paper Q back, the intermediate roller 24 may once again be driven, and the transport of the paper P and the printing may be started again, when the following end of the paper Q has once again passed the photosensor 121.

Furthermore, the double-sided printing unit 12 is not limited to being provided toward a rear surface of the device main body 1A and configuring the rear surface of the device main body 1A when in a mounted state. For example, a cover mounted so as to be capable of opening and closing is provided in the device main body so as to configure a rear surface of the device main body 1A, and this cover configures an outer side of the inverting transport path when in a closed state. The double-sided printing unit may be configured to be removable from the device main body 1A when the cover is open, and the double-sided printing unit may configure an inner side of the inverting transport path when the double-sided printing unit is mounted in the device main body 1A. Accordingly, when the cover is closed and the double-sided printing unit is mounted in the device main body 1A, the inverting transport path is configured and the recording paper can pass through the inverting transport path as a result.

By employing such a configuration, the double-sided printing unit can be reduced to functioning only so as to configure the inner side path of the inverting transport path, and thus even if the size of the device main body 1A increases, it is possible to suppress an increase in the size of the members that can be mounted in and removed from the device main body 1A.

The entire disclosure of Japanese Patent Application No.: 2013-071600, filed Mar. 29, 2013 and 2013-190195, filed Sep. 13, 2013 are expressly incorporated by reference herein.

What is claimed is:

1. A recording device comprising:

a device main body including a recording head that records onto a medium;

a unit member that forms a medium transport path for transporting the medium and is configured to be mountable in and removable from the device main body; and a first detection unit, provided in the device main body, that detects, via an opening provided in the unit member, the medium passing through the medium transport path in the unit member when the unit member is mounted in the device main body.

2. The recording device according to claim 1, wherein the medium transport path includes an inverting transport path that inverts the medium fed from the side on which the recording head is located; and the opening is provided in an upper area of the unit member.

3. The recording device according to claim 1, wherein the unit member includes a medium support surface that supports at least part of the medium before the medium is fed; and a feed path for the medium fed toward the recording head via the medium support surface is formed when the unit member is mounted in the device main body.

4. The recording device according to claim 3, wherein the feed path is formed so as to merge with the inverting transport path; and the first detection unit is provided downstream from the point where the feed path and the inverting transport path merge.

5. The recording device according to claim 3, wherein the first detection unit detects the medium at a location upstream in a medium feed direction from a roller pair that nips the medium and that is located furthest upstream in the feed path of the medium fed via the medium support surface.

6. The recording device according to claim 1, wherein at least a portion of the first detection unit projects toward a region of the device main body in which the unit member is mounted; and a groove that receives the projecting portion of the first detection unit is formed in an upper area of the unit member so as to extend in a direction along which the unit member is mounted and removed.

7. The recording device according to claim 1, wherein an image reading unit is provided in an upper area of the device main body; and a signal line of the first detection unit is disposed in a pathway of a connection cable that electrically connects the image reading unit to the device main body.

8. The recording device according to claim 1, further comprising:

a second detection unit, provided in the device main body, that detects the medium passing through the feed path upstream in the feed path from the point where the inverting transport path and the feed path merge.

9. The recording device according to claim 1, wherein the first detection unit is a photosensor including a light-emitting portion that emits detection light toward the opening and a light-receiving portion that receives reflected light from the opening.

10. The recording device according to claim 1, further comprising:

a biasing portion that biases the medium detected through the opening toward the open.

* * * * *